US011795697B2

(12) United States Patent
Chen

(10) Patent No.: US 11,795,697 B2
(45) Date of Patent: Oct. 24, 2023

(54) AUTOMATIC AWNING COMPONENT DEVICE

(71) Applicant: Suzhou Shoot Power Equipment Co., Ltd., Suzhou (CN)

(72) Inventor: Liren Chen, Suzhou (CN)

(73) Assignee: SUZHOU SHOOT POWER EQUIPMENT CO., LTD., Suzhou (CN)

( * ) Notice: Subject to any disclaimer, the term of this patent is extended or adjusted under 35 U.S.C. 154(b) by 214 days.

(21) Appl. No.: 17/056,813

(22) PCT Filed: Jan. 17, 2020

(86) PCT No.: PCT/CN2020/072636
§ 371 (c)(1),
(2) Date: Aug. 23, 2021

(87) PCT Pub. No.: WO2021/138935
PCT Pub. Date: Jul. 15, 2021

(65) Prior Publication Data

US 2022/0127855 A1 Apr. 28, 2022

(30) Foreign Application Priority Data

Jan. 8, 2020 (CN) ..... 202010018554.X

(51) Int. Cl.
*E04F 10/06* (2006.01)

(52) U.S. Cl.
CPC ..... *E04F 10/0614* (2013.01); *E04F 10/0603* (2013.01); *E04F 10/0625* (2013.01);
(Continued)

(58) Field of Classification Search
CPC ..... E04F 10/0614; E04F 10/0648; E04F 10/0625; E04F 10/0651; E04F 10/0603; E04F 10/0662
See application file for complete search history.

(56) References Cited

U.S. PATENT DOCUMENTS 6,341,638 B1 * 1/2002 Thompson ..... E04F 10/08 160/67
6,971,433 B2 * 12/2005 Wagner ..... E04F 10/0614 160/67

(Continued)

FOREIGN PATENT DOCUMENTS

CN 102031850 A 4/2011
CN 201933715 U 8/2011

(Continued)

OTHER PUBLICATIONS

International search report of PCT/CN2020/072636.

*Primary Examiner* — Abe Massad
(74) *Attorney, Agent, or Firm* — Zhigang Ma

(57) ABSTRACT

The present invention discloses an automatic awning component device, which comprises a pair of folding-unfolding units installed at an interval, wherein an awning unit is arranged between the two folding-unfolding units; the folding-unfolding unit comprises a support link, a first connecting rod, a second connecting rod, a telescopic connecting rod and a fixing frame to be fixed on the mounting surface; the awning unit comprises a tarpaulin winding shaft arranged between the two support links, and a flexible tarpaulin is wound on the tarpaulin winding shaft. The automatic awning component device in the invention is installed on the corresponding mounting surface through the fixing frame, the folding-unfolding units are driven by a drive mechanism motor and a pneumatic telescoping part to realize automatic folding and unfolding. The invention has a reasonable overall structure and a high degree of automation.

11 Claims, 10 Drawing Sheets

(52) U.S. Cl.
CPC ..... *E04F 10/0629* (2013.01); *E04F 10/0648* (2013.01); *E04F 10/0655* (2013.01)

(56) References Cited

U.S. PATENT DOCUMENTS

| | | | | |
|---|---|---|---|---|
| 9,175,481 | B2 * | 11/2015 | Albrecht | E04F 10/0625 |
| 10,151,116 | B2 * | 12/2018 | Thompson | E04F 10/0625 |
| 10,947,737 | B2 * | 3/2021 | Meyers | E04F 10/0625 |
| 2003/0094833 | A1 * | 5/2003 | Thompson | E04H 15/08 296/173 |
| 2004/0221965 | A1 | 11/2004 | Wagner et al. | |
| 2010/0122777 | A1 * | 5/2010 | Gutierrez | E04F 10/0603 160/67 |
| 2013/0333736 | A1 | 12/2013 | Albrecht et al. | |
| 2017/0088068 | A1 * | 3/2017 | Taylor | B60R 16/027 |

FOREIGN PATENT DOCUMENTS

| | | | |
|---|---|---|---|
| EP | 0980787 | A2 | 2/2000 |
| EP | 1074675 | A2 | 2/2001 |

* cited by examiner

AUTOMATIC AWNING COMPONENT DEVICE

TECHNICAL FIELD

The invention relates to the technical field of awning, in particular to an automatic awning component device.

BACKGROUND ART

Awnings are widely used for the doorways and windows of permanent houses, recreational vehicles, coffee shops, business premises to provide outdoor expansion space. Awnings can not only provide shade to avoid direct sunlight, but also provide a temporary rain shelter.

In the prior art, the awnings widely used in the houses or recreational vehicle market also have some technical defects such as large folding size, low structural strength and high weight. For example, in the U.S. patent with patent number of U.S. Pat. No. 6,971,433B2, the supporting arm adopts the double-link structure, which will increase the weight and structural complexity. The U.S. patent with patent number of U.S. Pat. No. 10,151,116B2 has improved U.S. Pat. No. 6,971,433B2 patent in the terms of compactness, but the hollowed-out section bars are used and part of section bars are extremely thin to easily cause low overall structural strength, the support strength cannot be guaranteed, and it is easy to damage in case of exposure to outside impact, so it is difficult to guarantee safety during use. In addition, in the U.S. patent with patent number of US 2010/0122777 A1, the sectional area of the shell must be increased due to its support structure to result in failure to be completely folded, and there are large gaps at the bottom and on the shell. Due to the failure to achieve complete folding, it is easy to cause safety hazards when it is applied to the vehicles.

SUMMARY OF THE INVENTION

Aiming at the defects in the prior art, the invention aims to propose an automatic awning component device, which has a compact structure and can realize complete folding after use to avoid safety hazards. The concrete proposal is as follows:

An automatic awning component device comprises a pair of folding-unfolding units installed at intervals, wherein an awning unit is arranged between the two folding-unfolding units, the folding-unfolding unit comprises a support link, a first connecting rod, a second connecting rod, a telescopic connecting rod and a fixing frame to be fixed on the mounting surface, one end of the first connecting rod is hinged with the upper end of the fixing frame, and the other end thereof is hinged between two ends of the support link, and the telescopic connecting rod can extend along the extension direction and is arranged between the fixing frame and the first connecting rod. One end of the telescopic connecting rod (500) is hinged with two ends of the first connecting rod, and the other end thereof adopts sliding fit with the fixing frame; one end of the second connecting rod is hinged with two ends of the telescopic connecting rod, and the other end thereof is hinged with the rear end of the support link; a pneumatic telescoping part is also arranged between the fixing frame and the first connecting rod, one end of the pneumatic telescoping part is hinged between the fixing frame of the connecting rod and the telescopic connecting rod, the other end thereof is hinged between the telescopic connecting rod of the fixing frame and the upper end of the of the fixing frame, and the support link is folded to the position coinciding with the fixing frame when the pneumatic telescoping part completely retracts.

The awning unit comprises a tarpaulin winding shaft arranged between the two support links, a flexible tarpaulin is wound on the tarpaulin winding shaft, the end of the tarpaulin winding shaft is connected with a drive mechanism arranged at the front end of the support link in a driving way, and the drive mechanism can drive the tarpaulin winding shaft (800) to rotate, so that the flexible tarpaulin is unfolded or folded.

In this technical proposal, the automatic awning component device is installed on the corresponding mounting surface through the fixing frame, the tarpaulin winding shaft positioned at the front end of the support link is used to expand or retract the flexible tarpaulin, and the end of the flexible tarpaulin is fixed between two fixing frames of the mounting surface during installation; when the drive mechanism drives the tarpaulin winding shaft to rotate and cause the flexible tarpaulin to expand, the pneumatic telescoping part can automatically extend, so that the first connecting rod, the second connecting rod and the telescopic connecting rod are unfolded when sliding; after the flexible tarpaulin expands, the angle between the flexible tarpaulin and the mounting surface can be formed by adjusting the length of telescopic connecting rod, facilitating adjustment of the shielding angle at different times, so as to change the projection area of the flexible tarpaulin.

When the drive mechanism drives the tarpaulin winding shaft to rotate reversely to retract the flexible tarpaulin, the first connecting rod, the second connecting rod and the telescopic connecting rod can overcome the pneumatic resistance of the pneumatic telescoping part and make the support link rotate to the coinciding position with the fixing frame to realize complete folding, and then safety risks can be effectively avoided.

Preferably, side skirt parts are arranged on the edge of two sides in the length direction of the support link, the first connecting rod and the second connecting rod, so that the cross sections of the support link, the first connecting rod and the second connecting rod are arranged in U shape, and the length direction edges of the support link and the first connecting rod are connected with the side skirt parts in a transitional way through transition strengthening parts with arc-shaped cross sections; when the support links rotate to coincide with the fixing frames, the side skirt parts arranged on both sides of the support links are located outside the fixing frames. The side skirt parts can ensure that a space for accommodating the fixing frames is formed inside the support links, so that the support links can completely coincide with the fixing frames after being folded, improving the stability after folding. The transition strengthening part can improve the structural strength of the support links.

Preferably, a clamping part with cross section arranged in an arch shape is arranged at the end of the side skirt part of the support link, and the inner wall of the clamping part can prop against the outer surface of the fixing frame when the support link coincides with the fixing frame. The clamping part props against the outer surface of the fixing frame, improving the stability of the support links after folding.

Preferably, U-shaped slideways with cross sections arranged in U shape are arranged on the edges of the two sides in the length direction of the fixing frame, the U-shaped slideways are arranged along the extension direction of the fixing frame, and the notches of the two U-shaped slideways are arranged oppositely, the U-shaped slideways realize sliding fit with the end of the telescopic connecting rod, limit parts are arranged in the U-shaped slideways of the fixing frames, and the end of the telescopic connecting rod (500) props against the limit part when the support link rotates to the fully unfolded position.

Preferably, the telescopic connecting rod comprises a base segment and an extension segment plugged at the end of the base segment in a sliding way, slideways are arranged on two sides of the inner wall for the base segment and adopt sliding fit with sliding flanges arranged outside the extension segment, and a pulley structure adopting sliding fit with the U-shaped slideways of the fixing frame is arranged at one end of the extension segment away from the base segment. The whole length of the telescopic connecting rod can be adjusted by adjusting the length of the extension segment. At the same time, the sliding fit with the fixing frames can be realized by the pulley structure.

Preferably, a flat V-spring is arranged at one end of the extension segment extended into the base segment, and clamping heads are arranged at two ends of the flat V-spring, pass through the side wall of the extension segment and are clamped with adjusting holes arranged on the side of the base segment. The flat V-spring can control the extension length of the extension segment.

Preferably, the drive mechanism comprises revolving shaft connecting plates arranged at the front ends of two support links, wherein each revolving shaft connecting plate is removably connected with the corresponding end of the tarpaulin winding shaft; one of the revolving shaft connecting plates is connected to a driving motor in a driving way. Both ends of the tarpaulin winding shaft can be installed between the two support links through the revolving shaft connecting plates. At the same time, one of the revolving shaft connecting plates is connected with the driving motor in a driving way, so that the driving motor can drive the tarpaulin winding shaft to rotate stably.

Preferably, the driving motor is connected to the revolving shaft connecting plate through a self-locking drive component in a driving way, the self-locking drive component comprises a pair of drive shafts, a pair of mutually meshed drive gears are respectively arranged on the two drive shafts, one drive shaft is connected to an output shaft of the driving motor through a worm gear mechanism in a driving way, and the other drive shaft is connected to the revolving shaft connecting plate in a driving way. The driving motor can output stable power through the variable speed drive of the drive gears to ensure the folding stability of the flexible tarpaulin. In addition, the worm gear structure can realize self-locking, which not only ensures that the extension length of the flexible tarpaulin can be locked arbitrarily, but also improves the stability of the flexible tarpaulin after folding or unfolding.

Preferably, the automatic awning component device also comprises a protective housing accommodating the driving motor and the self-locking drive component, the protective housing comprises an upper protective housing and a lower protective housing which are connected in a fastening way, and the protective housing is connected to a motor assembly connector, which is fixedly connected with the front end of the support link. The protective housing plays a protective role to avoid the internal damage to the drive mechanism.

The present invention has the advantages that the automatic awning component device in the invention is installed on the corresponding mounting surface through the fixing frames, and the support links can be folded and unfolded automatically under the drive of the drive mechanism motor and the pneumatic telescoping part. After unfolding, the shade area can be adjusted according to the need, and the device can be fully folded under the locking action of the drive mechanism. The device has a compact structure, and can ensure the safe driving of recreational vehicle and other mobile vehicle after being folded, thereby avoiding potential safety hazards. The invention has reasonable structure and high degree of automation, effectively solving the existing technical problems in the prior art and having high practical value.

BRIEF DESCRIPTION OF DRAWINGS

In order to describe the embodiments of the invention or the technical proposal in the prior art more clearly, the drawings to be used in the description of embodiments or prior art are briefly introduced below. In all drawings, similar elements or parts are generally identified by similar reference signs for drawings. In the drawings, the elements or parts are not always drawn to their actual scales.

Figure 1:
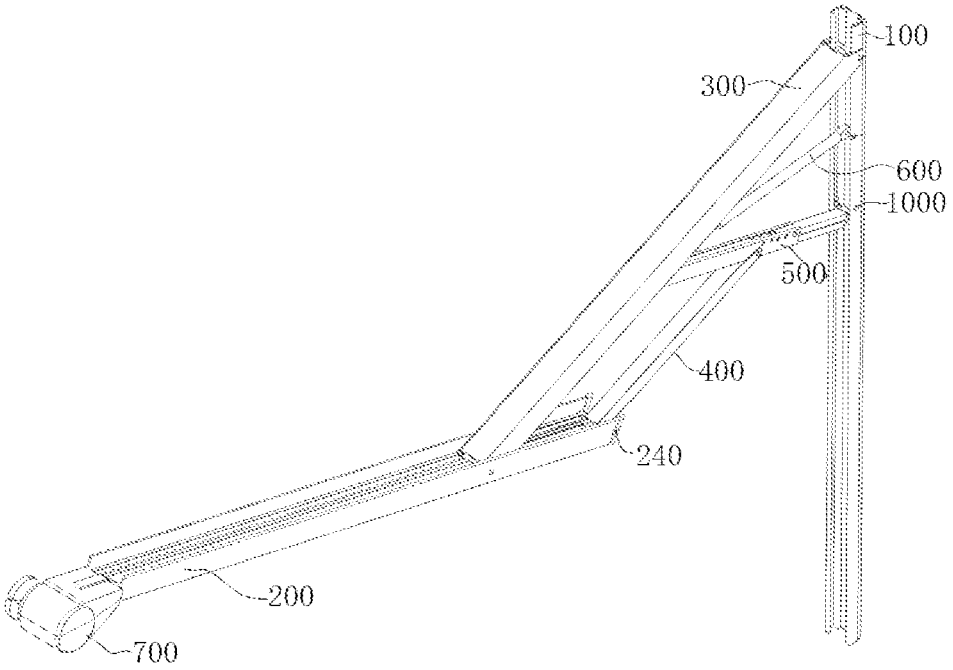
FIG. 1 is a stereogram for the folding-unfolding unit of an automatic awning component device provided by an embodiment.

REFERENCE SIGNS IN THE DRAWINGS fixing frame 100, U-shaped slideway 110, support link 200, clamping part 210, protective cover 220, first connecting rod 300, second connecting rod 400, telescopic connecting rod 500, base segment 510, adjusting hole 511, slideway 512, extension segment 520, mounting base 521, pulley block 522, revolving shaft 523, flat V-spring 530, pneumatic telescoping part 600, drive mechanism 700, drive motor 710, drive shaft 720, drive gear 730, revolving shaft connecting plate 740, upper protective cover 750, lower protective cover 760, motor assembly connector 770, tarpaulin winding shaft 800, flexible tarpaulin 900, limit part 1000, side skirt part 1100, transition strengthening part 1200.

DETAILED DESCRIPTION OF PREFERRED EMBODIMENTS

Here, it should be noted that the functions and methods involved in the invention are only the conventional adaptive applications of the prior art. Therefore, the improvement of the invention to the prior art substantially lies in the connection relationship between hardware, rather than the functions and methods. In other words, although the invention involves some functions and methods, the invention excludes the improvement of functions and methods. The description of functions and methods in the invention is to better describe the invention, so as to better understand it.

As shown in FIG. 1 to FIG. 13, in an embodiment, the invention provides an automatic awning component device, which comprises a pair of folding-unfolding units installed at intervals, wherein an awning unit is arranged between the two folding-unfolding units, and the folding-unfolding units can be used as the supporting pieces of the awning unit so that the awning unit is unfolded to be used as the awning. In concrete, the folding-unfolding unit comprises support links 200, a first connecting rod 300, a second connecting rod 400, a telescopic connecting rod 500 and a fixing frame 100 to be fixed on the mounting surface, one end of the first connecting rod 300 is hinged with the upper end of the fixing frame 100, and the other end thereof is hinged with two ends of the support links 200, the telescopic connecting rod 500 can extend along the extension direction and is arranged between the fixing frame 100 and the first connecting rod 300, one end of the telescopic connecting rod 500 is hinged between the two ends of the first connecting rod 300, and the other end thereof adopts sliding fit with the fixing frame 100; one end of the second connecting rod 400 is hinged between two ends of the telescopic connecting rod 500, and the other end thereof is hinged with the rear end of the support link 200; a pneumatic telescoping part 600 is also arranged between the fixing frame 100 and the first connecting rod 300, one end of the pneumatic telescoping part 600 is hinged between the fixing frame 100 of the connecting rod and the telescopic connecting rod 500, and the other end thereof is hinged between the telescopic connecting rod 500 of the fixing frame 100 and the upper end of the fixing frame 100, and the support links 200 are folded to the coinciding position with the fixing frames 100 when the pneumatic telescoping part 600 fully retracts. As aforementioned, the entire automatic awning component device is installed on the corresponding mounting surface through the fixing frames 100, the support links 200 of the folding-unfolding unit can be unfolded or folded to the fixing frames 100 through the expansion and retraction of the pneumatic telescoping part 600, the awning unit supported by the folding-unfolding unit comprises an awning revolving shaft 800 arranged between the two support links 200, a flexible tarpaulin 900 is wound on the tarpaulin winding shaft 800, two ends of the tarpaulin winding shaft 800 are connected with a drive mechanism 700 arranged at the front end of the support link 200 in a driving way, and the drive mechanism 700 drive the tarpaulin winding shaft 800 to rotate, so that the flexible tarpaulin 900 is unfolded or folded.

Figure 2:
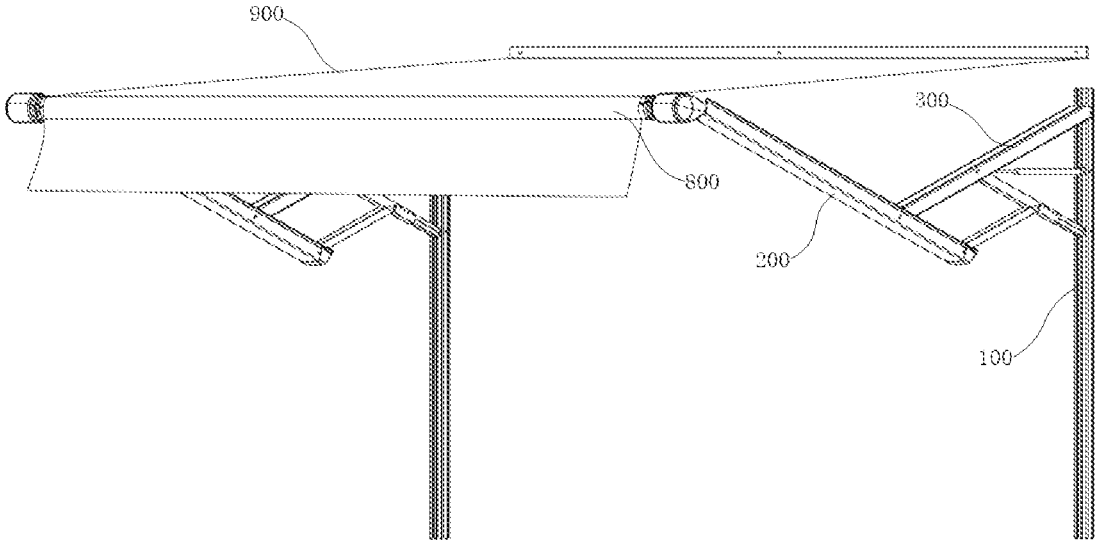
FIG. 2 is an unfolding stereogram of an automatic awning component device provided by an embodiment.
Figure 3:
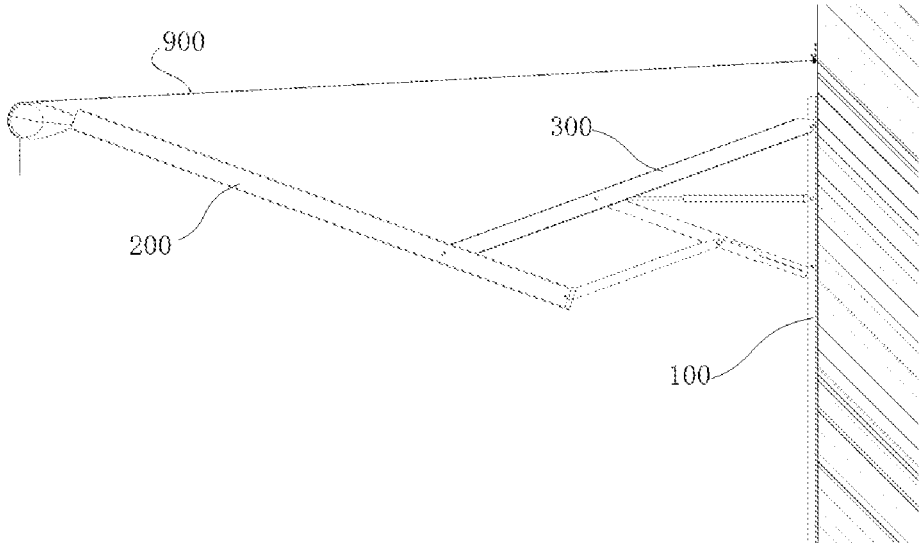
FIG. 3 is an unfolding side view of an automatic awning component device provided by an embodiment.
Figure 4:
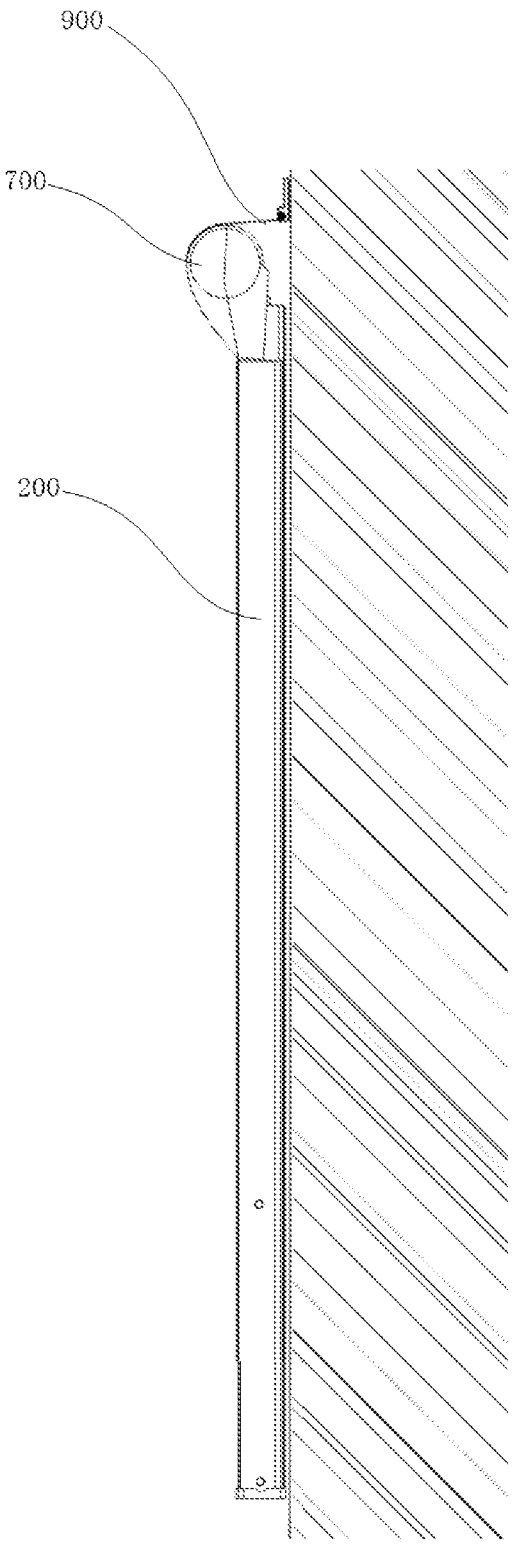
FIG. 4 is a folding side view of an automatic awning component device provided by an embodiment.
Figure 5:
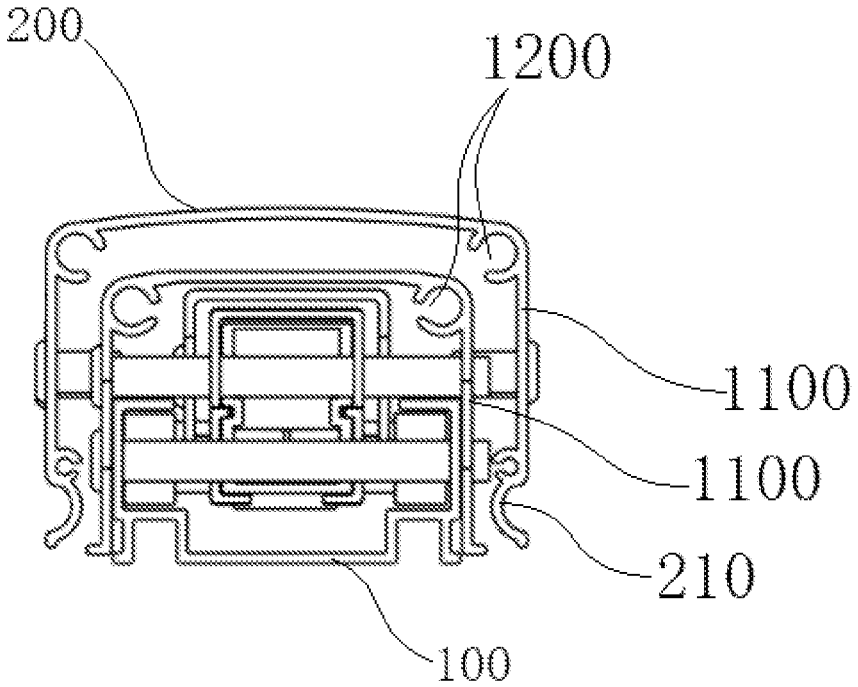
FIG. 5 is a folding sectional view for the folding-unfolding unit of an automatic awning component device provided by an embodiment.

As shown in FIG. 2 to FIG. 4, the tarpaulin winding shaft 800 positioned at the front end of the support links 200 is used to expand or retract the flexible tarpaulin 900, and the end of the flexible tarpaulin 900 is fixed between two fixing frames of the mounting surface during installation; when the drive mechanism 700 drives the tarpaulin winding shaft 800 to rotate and cause the flexible tarpaulin 900 to expand, the pneumatic telescoping part 600 can automatically extend, so that the first connecting rod 300, the second connecting rod 400 and the telescopic connecting rod 500 are unfolded when sliding; after the flexible tarpaulin 900 expands, the angle between the flexible tarpaulin 900 and the mounting surface can be formed by adjusting the length of telescopic connecting rod 500, facilitating adjustment of the shielding angle at different times, so as to change the projection area of the flexible tarpaulin 900.

As shown in FIG. 1 to FIG. 4, when the drive mechanism 700 drives the tarpaulin winding shaft 800 to rotate reversely to retract the flexible tarpaulin 900, the first connecting rod 300, the second connecting rod 400 and the telescopic connecting rod 500 can overcome the pneumatic resistance of the pneumatic telescoping part 600 and make the support links 200 rotate to the coinciding position with the fixing frame 100 to realize complete folding, and then safety risks can be effectively avoided.

In this embodiment, rivets are preferred for the hinged connection of the support links 200, the first connecting rod 300, the second connecting rod 400, the telescopic connecting rod 500 and the fixing frame 100. Rivets are more conducive to assembly. In addition, pneumatic telescoping part 600 is air spring, which is rapidly expanded through the pneumatic driven support links 200 during use.

As shown in FIG. 1 to FIG. 7, as previously mentioned, when the support links 200 are folded, the support links 200 rotate to coincide with the fixing frames 100, so that the first connecting rod 300, the second connecting rod 500 and the telescopic connecting rod 400 are positioned between the support links 200 and the fixing frames 100. In the embodiment, in order to improve the oneness and stability after folding, side skirt parts are arranged on the edges of two sides in the length direction of the support links 200, the first connecting rod 300 and the second connecting rod 400, so that the cross sections of the support links 200, the first connecting rod 300 and the second connecting rod 400 are arranged in U shape, and the length direction edges of the support links 200 and the first connecting rod 300 are connected with the side skirt parts 1100 in a transitional way through transition strengthening parts 1200 with arc-shaped cross sections. When the support links rotate to coincide with the fixing frames, the side skirt parts arranged on two sides of the support links are positioned outside the fixing frames. When the support links 200 are folded to coincide with the fixing frames 100, the fixing frames 100 are positioned between the two side skirt parts 1000 of the support links 200. The side skirt parts 1100 can ensure that a space for accommodating the fixing frames 100 is formed inside the support links 200, so that the support links 200 can completely coincide with the fixing frames 100 after being folded. The transition strengthening parts 1200 can improve the overall structural strength of the support links 200 and the first connecting rod 300. Further, in the embodiment, a clamping part 210 with cross section arranged in an arch shape is arranged at the end of the side skirt part 1100 of the support link 200, and the inner wall of the clamping part 210 can prop against the outer surface of the fixing frame 100 when the support link 200 coincides with the fixing frame 100. The clamping part 210 props against the outer surface of the fixing frame 100, improving the stability of the support links 200 after folding. In the embodiment, a protective cover 220 is inserted at the rear end of the support links 200 and can cover the lower end of the fixing frame 100 to protect the support links 200 when support links 200 rotate to the folding position and coincide with the fixing frames 100.

Figure 6:
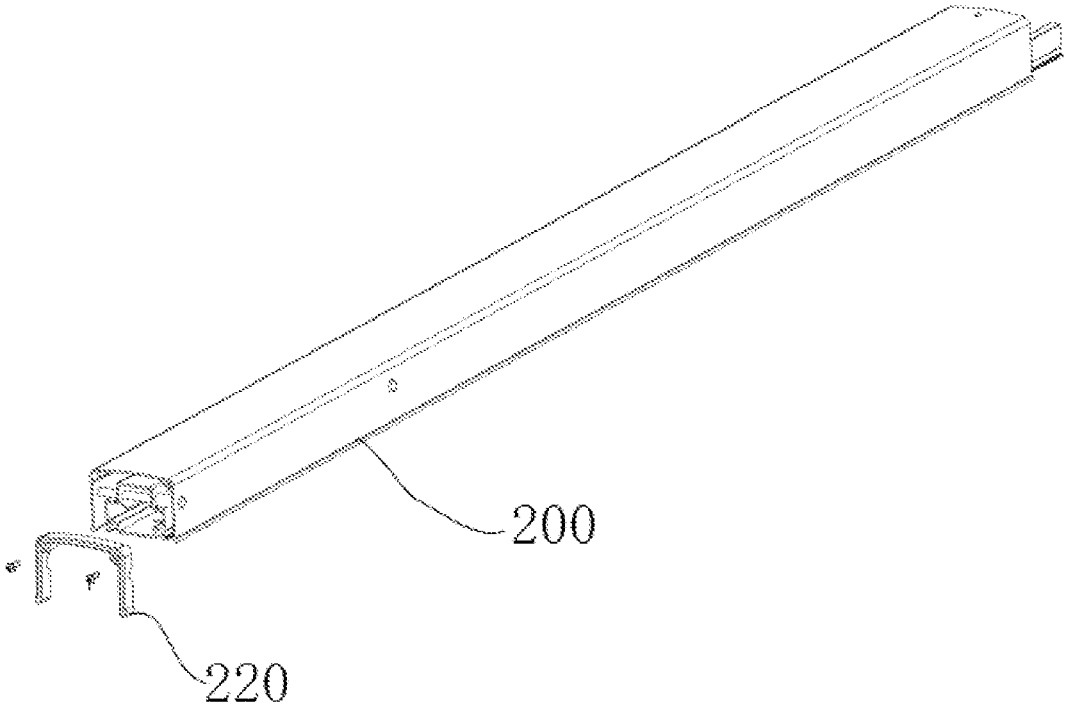
FIG. 6 is a stereogram for the support link of an automatic awning component device provided by an embodiment.
Figure 7:
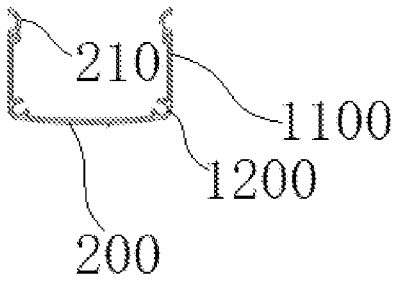
FIG. 7 is a sectional view for the support link of an automatic awning component device provided by an embodiment.
Figure 8:
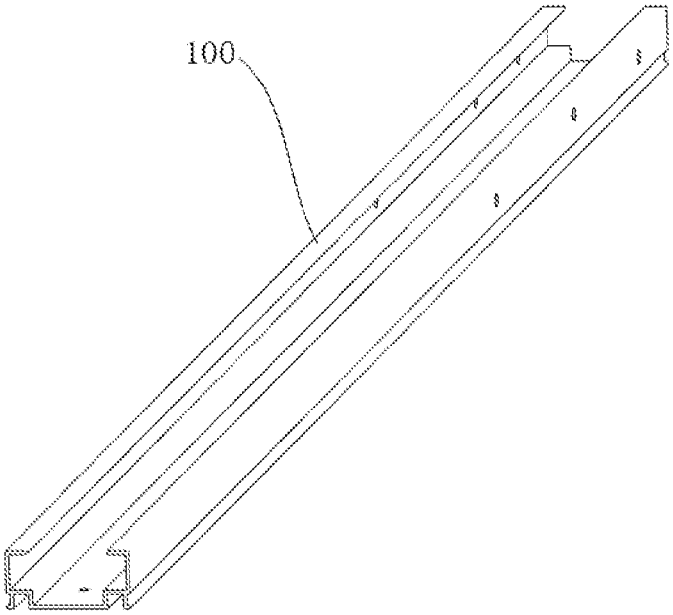
FIG. 8 is a stereogram for the fixing frame of an automatic awning component device provided by an embodiment.
Figure 9:
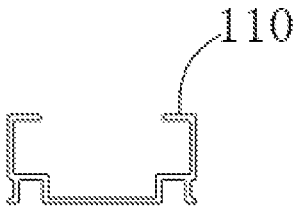
FIG. 9 is a sectional view for the fixing frame of an automatic awning component device provided by an embodiment.

As shown in FIG. 6 and FIG. 7, the flexible tarpaulin 900 is required to be supported when the support links 200 are unfolded. In order to ensure the structural strength of the support links 200, the transition strengthening parts with arc-shaped cross sections are arranged between the support links 200 and the side skirt parts 1100 in the embodiment. The transition strengthening parts can improve the overall structural strength of the support links 200 and avoid damage to the support links 200.

As previously mentioned, the telescopic connecting rod 500 and the fixing frames 100 form sliding fit. When the support links 200 are folded or unfolded, the end of the telescopic connecting rod 500 is required to slide stably along the extension direction of the fixing frames 100. In the embodiment, U-shaped slideways 110 with cross sections arranged in U shape are arranged on the edges of the two sides in the length direction of the fixing frame 100, the U-shaped slideways 110 are arranged along the extension direction of the fixing frame 100, and the notches of the two U-shaped slideways 110 are arranged oppositely, and the U-shaped slideways 110 realize sliding fit with the end of the telescopic connecting rod 500. Limit parts are arranged in the U-shaped slideways of the fixing frame, and the end of the telescopic connecting rod props against the limit part when the support links rotate to the fully unfolded position.

Figure 10:
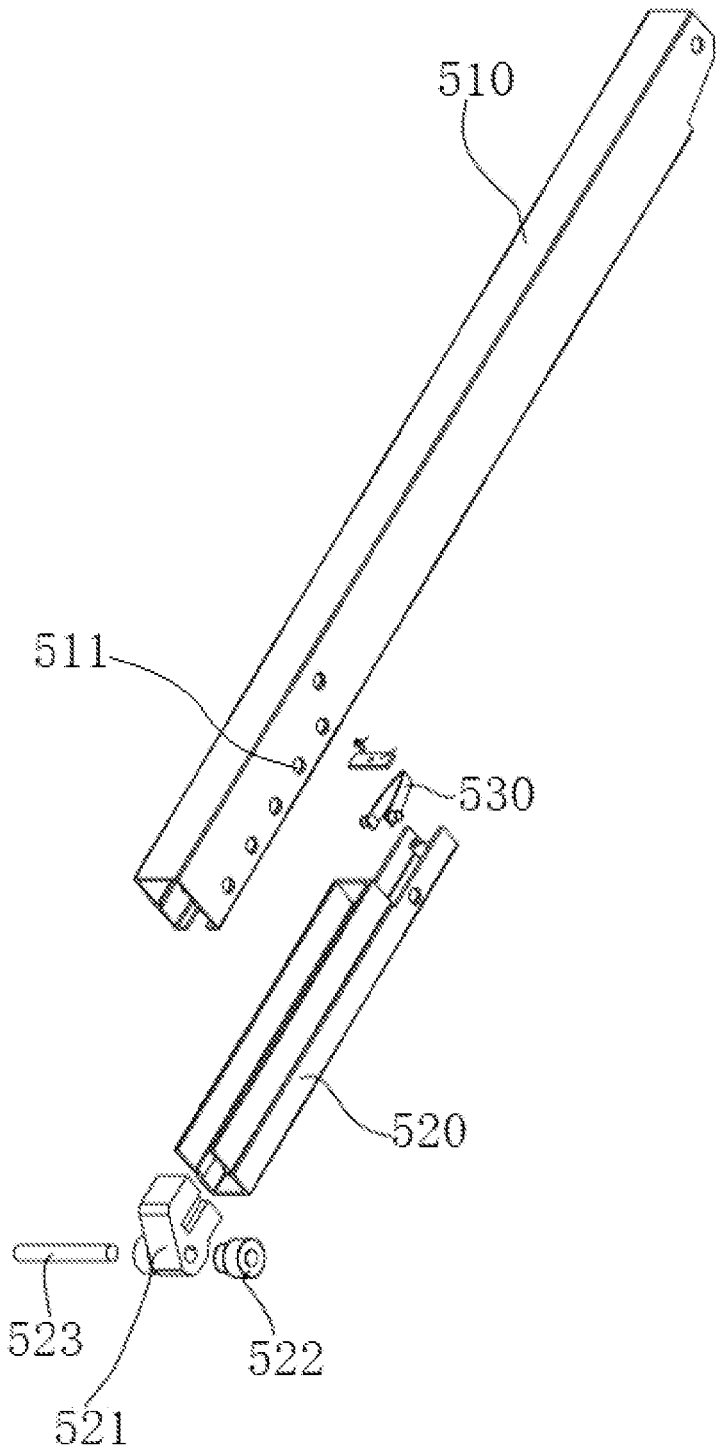
FIG. 10 is an explosive view for the telescopic connecting rod of an automatic awning component device provided by an embodiment.
Figure 11:
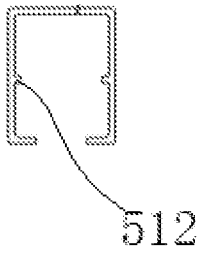
FIG. 11 is a sectional view for the base segment of the telescopic connecting rod of an automatic awning component device provided by an embodiment.

As shown in FIG. 10 and FIG. 11, as previously mentioned, the telescopic connecting rod 500 is required to realize the telescopic adjustment in length and form sliding fit with the fixing frame 100. The telescopic connecting rod 500 provided in the embodiment comprises a base segment 510 and an extension segment 520 plugged at the end of the base segment 510 in a sliding way, slideways 512 are arranged on two sides of the inner wall for the base segment 510 and adopt sliding fit with sliding flanges arranged outside the extension segment 520, and a pulley structure adopting sliding fit with the U-shaped slideways 110 of the fixing frame 100 is arranged at one end of the extension segment 520 away from the base segment 510. The whole length of the telescopic connecting rod 500 can be adjusted by adjusting the length of the extension segment 520. At the same time, the sliding fit with the fixing frames 100 can be realized through the pulley structure. Further, a flat V-spring 530 is arranged at one end of the extension segment 520 extended into the base segment 510, and clamping heads are arranged at two ends of the flat V-spring 530, pass through the side wall of the extension segment 520 and are clamped with adjusting holes 511 arranged on the side of the base segment 510. When the operator adjusts the length of the telescopic connecting rod 500, the extension segment 520 can slide by pressing the clamping heads of the flat V-spring 530, so that the clamping heads of the flat V-spring 530 are clamped into different adjusting holes 511 to control the extension length of the extension segment 520. In the embodiment, the pulley mechanism comprises a mounting base 521 inserted and fixed at one end of the extension segment 520 away from the base segment 510, and a pulley block 522 is rotationally installed on two sides of the mounting base 521 through a rotating shaft 523, so that the pulley block 522 is arranged in the slideway 512 of the fixing frame 100 in a rolling way.

Figure 12:
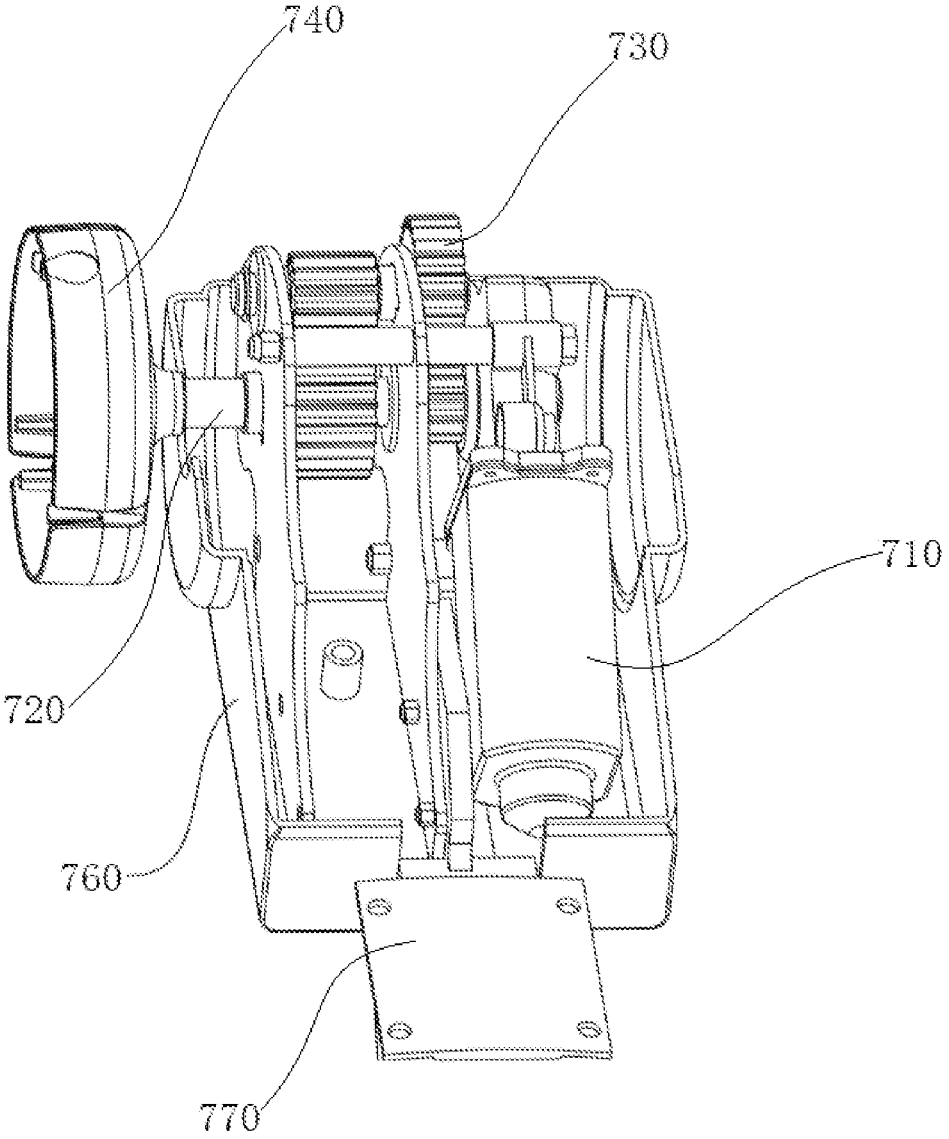
FIG. 12 is a stereogram 1 for the drive mechanism of an automatic awning component device provided by an embodiment.
Figure 13:
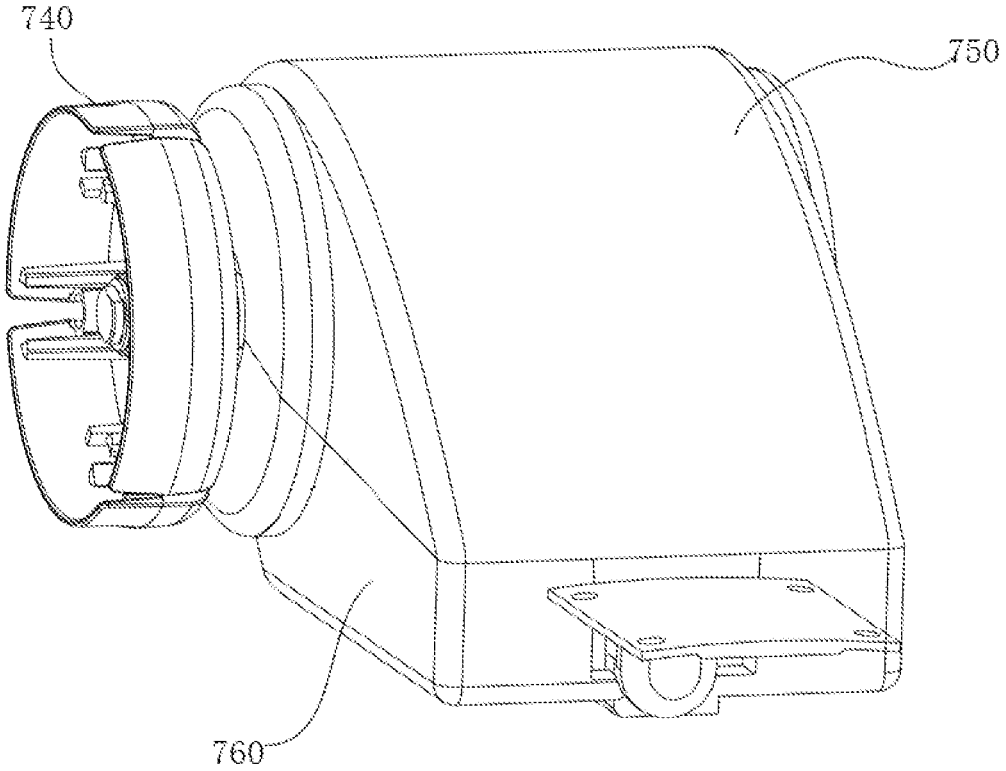
FIG. 13 is a stereogram 1 for the drive mechanism of an automatic awning component device provided by an embodiment.
Figure 14:
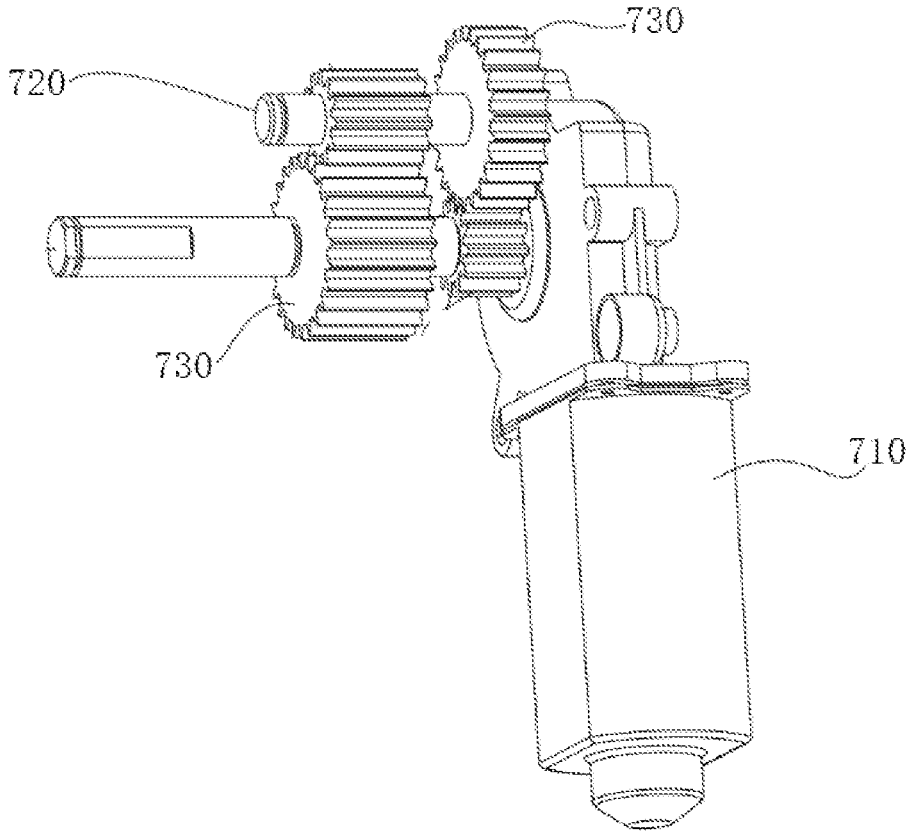
FIG. 14 is a drive diagram of an automatic awning component device provided by an embodiment.

As shown in FIG. 12 to FIG. 14, the drive mechanism 700 drives the flexible tarpaulin 900 to retract or expand. The drive mechanism 700 provided in the embodiment comprises revolving shaft connecting plates rotationally arranged at the front ends of the two support links, and each revolving shaft connecting plate is removably connected with one end of the tarpaulin winding shaft 800; one revolving shaft connecting plate is connected with a driving motor 710 in a driving way, and two ends of the tarpaulin winding shaft 800 can be installed between the two support links 200 through the revolving shaft connecting plate 740; at the same time, one revolving shaft connecting plate 740 is connected with the driving motor 710 in a driving way, and the driving motor 710 can drive the tarpaulin winding shaft 800 to rotate stably. In the embodiment, the revolving shaft connecting plate 740 is connected with the tarpaulin winding shaft 800 in a plugging way for easier assembly.

As shown in FIG. 12 to FIG. 14, the driving motor 710 is connected with the revolving shaft connecting plate 740 through the self-locking drive component in a driving way, the self-locking drive component comprises a pair of drive shafts 720, a pair of mutually meshed drive gears 730 are respectively arranged on the two drive shafts 720, one drive shaft 720 is connected to an output shaft of the driving motor 710 through a worm gear mechanism in a driving way, and the other drive shaft 720 is connected to the revolving shaft connecting plate 740 in a driving way. The driving motor 710 can output stable power through the variable speed drive of the drive gears 730 to ensure the folding stability of the flexible tarpaulin 900. In addition, the worm gear structure can realize self-locking, which not only ensures that the extension length of the flexible tarpaulin 900 can be locked arbitrarily, but also improves the stability of the flexible tarpaulin 900 after folding or unfolding.

Because the entire device is mostly used outdoors, the embodiment also provides a protective housing for accommodating the driving motor 710 and the self-locking drive component in order to prevent damage to the drive structure, the protective housing comprises an upper protective housing 750) and a lower protective housing 760) which are connected in a fastening way, and the protective housing is connected to a motor assembly connector 770), which is fixedly connected with the front end of the support link 200). The protective housing plays a protective role to avoid the internal damage to the drive mechanism 700.

Finally, it should be noted that the above embodiments are only used to describe the technical proposal of the invention and not to restrict it; notwithstanding the detailed description of the invention with reference to the aforementioned embodiments, the ordinary technicians in the field shall understand that they may still modify the technical proposal recorded in the aforementioned embodiments, or substitute some or all of the technical features thereof equally; however, these modifications or substitutions do not make the essence of the corresponding technical proposal divorced from the scope of the technical proposal for the embodiments of the invention, and shall be covered in the scope of the claims and specification of the invention.

The invention claimed is:

1. An automatic awning component device, comprising an awning unit and two folding-unfolding units positioned at two ends of the awning unit and driving the awning unit to be opened or closed when the folding-unfolding units are folded or unfolded, wherein, each folding-unfolding unit comprises a support link (200), a first connecting rod (300), a second connecting rod (400), a telescopic connecting rod (500) and a fixing frame (100) positioned on a mounting surface; one end of the first connecting rod (300) is hinged with an end of the fixing frame (100), and another end of the first connecting rod (300) is hinged with the support link (200) between a front end and a distal end of the support link (200), the telescopic connecting rod (500) is arranged between the fixing frame (100) and the first connecting rod (300), a first end of the telescopic connecting rod (500) adopts a sliding fit with the fixing frame, and a second end of the telescopic connecting rod (500) is hinged with the two ends of the first connecting rod (300); one end of the second connecting rod (400) is connected with the distal end of the support link (200), and another end of the second connecting rod (400) is hinged with the telescopic connecting rod (500) adjacent to the first connecting rod (300); when the first connecting rod (300) rotates clockwise or counterclockwise around a hinged joint between the first connecting rod (300) and the end of the fixing frame (100), and the support link (200) can be unfolded outward or rotate to a position coinciding with the fixing frame (100); side skirt parts (1100) are arranged on edges of two sides in a length direction of the support link (200), the first connecting rod (300) and the second connecting rod (400), so that cross sections of the support link (200), the first connecting rod (300) and the second connecting rod (400) are arranged in a U shape, and length direction edges of the support link (200) and the first connecting rod (300) are connected with the side skirt parts (1100) through transition strengthening parts (1200); when the support link (200) rotates to coincide with the fixing frame (100), the side skirt parts (1100) arranged on both sides of the support link (200) are located outside the fixing frames (100);

wherein the fixing frame (100) has a U shape cross section, when the folding-unfolding units are folded, the second connecting rod (400) and the telescopic connecting rod (500) are received in the fixing frame (100), the fixing frame (100) is received in the first connecting rod (300), and the first connecting rod (300) is received in the support link (200);

each transition strengthening part (1200) has a C-shaped cross section with two ends extending towards an inside of the first connecting rod (300) or the support link (200);

a pneumatic telescoping part is arranged between the fixing frame and the first connecting rod, one end of the pneumatic telescoping part is hinged with the first connecting rod between the fixing frame and the telescopic connecting rod, and another end of the pneumatic telescoping part is hinged to the fixing frame between the first connecting rod and the telescopic connecting rod, so that the first connecting rod is capable of rotating around the one end at which the first connecting rod is hinged with the fixing frame under the thrust of the pneumatic telescoping part; and the telescopic connecting rod (500) comprises a base segment (510) and an extension segment (520) slidably arranged at an end of the base segment (510), U-shaped slideways (512) are arranged on two sides of an inner wall of the base segment (510) and adopt sliding fit with sliding flanges arranged outside the extension segment (520), and a pulley structure adopting a sliding fit with the U-shaped slideways (110) of the fixing frame (100) is arranged at one end of the extension segment (520) away from the base segment (510).

2. The automatic awning component device according to claim 1, wherein, on each folding-unfolding unit, a clamping part (210) with a cross section arranged in an arch shape is arranged at an end of the side skirt part (1100) of the support link (200), and an inner wall of the clamping part (210) can prop against an outer surface of the fixing frame (100) when the support link (200) coincides with the fixing frame (100).

3. The automatic awning component device according to claim 2, wherein the awning unit comprises a tarpaulin winding shaft (800) arranged between the two support links (200), a flexible tarpaulin (900) is wound on the tarpaulin winding shaft (800), an end of the tarpaulin winding shaft (800) is connected with a drive mechanism (700) arranged at the front end of one of the support links (200), and the drive mechanism (700) can drive the tarpaulin winding shaft (800) to rotate, so that the flexible tarpaulin (900) is unfolded or folded.

4. The automatic awning component device according to claim 1, wherein, on each folding-unfolding unit, U-shaped slideways (110) with cross sections arranged in a U shape are arranged on two sides in a length direction of the fixing frame (100), the U-shaped slideways (110) are arranged along an extension direction of the fixing frame (100), and notches of the two U-shaped slideways (110) are arranged oppositely, the U-shaped slideways adopt sliding fit with an end of the telescopic connecting rod, limit parts (1000) are arranged in the U-shaped slideways of the fixing frame (100), and the end of the telescopic connecting rod (500) props against the limit parts (1000) when the support link (200) rotate to an fully unfolded position.

5. The automatic awning component device according to claim 4, wherein the awning unit comprises a tarpaulin winding shaft (800) arranged between the two support links (200), a flexible tarpaulin (900) is wound on the tarpaulin winding shaft (800), an end of the tarpaulin winding shaft (800) is connected with a drive mechanism (700) arranged at the front end of one of the support links (200), and the drive mechanism (700) can drive the tarpaulin winding shaft (800) to rotate, so that the flexible tarpaulin (900) is unfolded or folded.

6. The automatic awning component device according to claim 1, wherein, on each folding-unfolding unit, a flat V-spring (530) is arranged at another end of the extension segment (520) extended into the base segment (510), and clamping heads are arranged at two ends of the flat V-spring (530), pass through a side wall of the extension segment (520) and are clamped with adjusting holes (511) arranged on a side of the base segment (510).

7. The automatic awning component device according to claim 4, wherein the awning unit comprises a tarpaulin winding shaft (800) arranged between the two support links (200), a flexible tarpaulin (900) is wound on the tarpaulin winding shaft (800), an end of the tarpaulin winding shaft (800) is connected with a drive mechanism (700) arranged at the front end of one of the support links (200), and the drive mechanism (700) can drive the tarpaulin winding shaft (800) to rotate, so that the flexible tarpaulin (900) is unfolded or folded.

8. The automatic awning component device according to claim 1, wherein the awning unit comprises a tarpaulin winding shaft (800) arranged between the two support links (200), a flexible tarpaulin (900) is wound on the tarpaulin winding shaft (800), an end of the tarpaulin winding shaft (800) is connected with a drive mechanism (700) arranged at the front end of one of the support links (200), and the drive mechanism (700) can drive the tarpaulin winding shaft (800) to rotate, so that the flexible tarpaulin (900) is unfolded or folded.

9. The automatic awning component device according to claim 8, wherein the drive mechanism (700) comprises revolving shaft connecting plates (740) arranged at the front ends of the two support links (200), wherein each revolving shaft connecting plate (740) is removably connected with a corresponding end of the tarpaulin winding shaft (800); a first one of the revolving shaft connecting plates (740) is connected to a driving motor (710).

10. The automatic awning component device according to claim 9, wherein the driving motor (710) is connected to the first revolving shaft connecting plate (740) through a self-locking drive component, the self-locking drive component comprises a pair of drive shafts (720), a pair of mutually meshed drive gears (730) are respectively arranged on the pair of drive shafts (720), one of the drive shafts (720) is connected to an output shaft of the driving motor (710) through a worm gear mechanism, and another one of the drive shafts (720) is connected to the first revolving shaft connecting plate (740).

11. The automatic awning component device according to claim 10, wherein the automatic awning component device comprises a protective housing accommodating the driving motor (710) and the self-locking drive component, the protective housing comprises an upper protective housing (750) and a lower protective housing (760) which are connected, and the protective housing is connected to a motor assembly connector (770), which is fixedly connected with the front end of one of the support links (200).

* * * * *